US005492705A

United States Patent [19]

Porchia et al.

[11] Patent Number: 5,492,705

[45] Date of Patent: Feb. 20, 1996

[54] VEGETABLE CONTAINING STORAGE BAG AND METHOD FOR STORING SAME

[75] Inventors: Jose Porchia; Brian C. Dais; Zain E. M. Saad, all of Midland, Mich.

[73] Assignee: Dowbrands L.P., Indianapolis, Ind.

[21] Appl. No.: 326,167

[22] Filed: Oct. 19, 1994

Related U.S. Application Data

[63] Continuation of Ser. No. 874,653, Apr. 27, 1992, abandoned.

[51] Int. Cl.[6] ..... A23B 7/00; B65D 33/01

[52] U.S. Cl. ..... 426/106; 426/118; 426/132; 426/415; 426/419; 383/103

[58] Field of Search ..... 426/106, 118, 426/132, 415, 419; 383/103

[56] References Cited

U.S. PATENT DOCUMENTS

| | | | |
|---|---|---|---|
| H 9 | 1/1986 | Ashmore | 206/497 |
| 882,134 | 3/1908 | Woodard . | |

(List continued on next page.)

FOREIGN PATENT DOCUMENTS

| | | | |
|---|---|---|---|
| 909726 | 9/1972 | Canada | 220/6 |
| 984113 | 2/1976 | Canada . | |
| 1009411 | 5/1977 | Canada . | |
| 1035522 | 8/1978 | Canada | 18/211 |
| 1086271 | 9/1980 | Canada . | |
| 1090083 | 11/1980 | Canada . | |
| 1111223 | 10/1981 | Canada . | |
| 1125973 | 6/1982 | Canada . | |
| 1125980 | 6/1982 | Canada . | |
| 1133411 | 10/1982 | Canada | 195/145 |
| 1243175 | 4/1984 | Canada . | |
| 1250255 | 3/1985 | Canada . | |
| 1219718 | 3/1987 | Canada . | |
| 1222976 | 6/1987 | Canada . | |
| 1224762 | 7/1987 | Canada . | |
| 1236672 | 5/1988 | Canada . | |
| 1242062 | 9/1988 | Canada . | |
| 1269217 | 5/1990 | Canada . | |
| 2070772 | 6/1991 | Canada . | |
| 12195972 | 2/1992 | Canada . | |
| 2050145 | 3/1993 | Canada . | |
| 1597842 | 8/1968 | France . | |
| 2802849 | 7/1978 | Germany . | |
| 3245196 | 6/1984 | Germany . | |
| 9011562 | of 1990 | Germany . | |
| 57-163661 | 10/1982 | Japan . | |
| 2-258560 | 10/1990 | Japan . | |
| 6502210 | 8/1966 | Netherlands . | |
| 7015228 | 4/1971 | Netherlands | 426/415 |
| 7801075 | 9/1978 | Netherlands . | |
| 2179025 | of 1987 | United Kingdom . | |
| WO90/02088 | 3/1990 | WIPO . | |

OTHER PUBLICATIONS

CAP '84, Proceedings of Intl. Conference on Controlled ATM Packaging 1984.

Ethyl Corp. Brochure—VISPore Recvd Aug. 1983.

J of Food Protection vol. 41 #5 pp. 348–350 May 1978.

CSIRO 1984 CSIRO Food Res Q 44(2), 25–33.

Modern Packaging Oct. 1949 p. 106.

Modern Packaging 40, #2, 1966.

Revue Generale Du Froid, No. 3, Mar. 1974.

Publication in "Diario de Centro America, Nov. 22, 1985" of Guatemala patent application, Guatemala File PI–85–00–022, Film To Package Bananas Or plantains, Ernesto Ricardo Viteri Echeverria, representative of Exxon Research and Engineering Co., an entity of the United States of America, Spanish with English translation.

J. Weichmann, Respiration And Gas Exchange, 1987, p. 33, Postharvest Physiology of Vegtables, Marcel Dekker, Inc., New York, New York.

*Primary Examiner*—Steven Weinstein

[57] ABSTRACT

A flexible film and flexible food storage bag for packaging produce such as vegetables and fruits wherein the film or bag has plurality of microholes specifically designed to allow the produce to breath in a controlled rate such that localized condensation and weight loss is minimized, which in turn reduces microbial (bacteria and mold) growth and reduces produce mushiness (softness) respectively.

28 Claims, 2 Drawing Sheets

U.S. PATENT DOCUMENTS

| | | | |
|---|---|---|---|
| 2,452,174 | 10/1948 | Arnold | 426/87 |
| 2,571,340 | 10/1951 | Carson | 426/106 |
| 2,595,708 | 5/1952 | Salfisberg | 206/46 |
| 2,704,099 | 3/1955 | Wikle | 150/1 |
| 2,748,863 | 6/1956 | Benton | 164/99 |
| 2,760,576 | 8/1956 | Spencer | 164/99 |
| 3,040,966 | 6/1962 | Crane | 229/53 |
| 3,130,505 | 4/1964 | Markevitch | 36/45 |
| 3,146,283 | 8/1964 | Da Valle | 264/156 |
| 3,161,554 | 12/1964 | Blackford | 156/242 |
| 3,171,749 | 3/1965 | Dreyfus et al. . | |
| 3,187,380 | 6/1965 | Harrison | 18/1 |
| 3,214,795 | 11/1965 | Hannauer | 18/10 |
| 3,218,178 | 11/1965 | Pava | 426/106 |
| 3,227,854 | 1/1966 | Ramsey | 219/244 |
| 3,245,606 | 4/1966 | Crane | 229/53 |
| 3,316,411 | 4/1967 | Linderman | 250/219 |
| 3,355,974 | 12/1967 | Carmichael | 83/171 |
| 3,384,696 | 5/1968 | Makansi | 264/321 |
| 3,399,822 | 9/1968 | Kugler | 229/62.5 |
| 3,423,212 | 1/1969 | Purcell et al. | 426/415 |
| 3,435,190 | 3/1969 | Schirmer | 219/384 |
| 3,450,543 | 10/1969 | Badron et al. | 426/415 |
| 3,546,327 | 12/1970 | Buda | 264/156 |
| 3,546,742 | 12/1970 | Kugler | 18/10 |
| 3,618,439 | 4/1971 | Zelnick | 83/171 |
| 3,679,540 | 7/1972 | Zimmerman et al. | 161/159 |
| 3,707,102 | 12/1972 | Huppenthal et al. | 83/171 |
| 3,718,059 | 2/1973 | Clayton | 83/2 |
| 3,795,749 | 3/1974 | Cummin et al. | 426/415 |
| 3,804,961 | 4/1974 | Cummin et al. | 426/415 |
| 3,839,525 | 10/1974 | Doll | 264/154 |
| 3,865,695 | 2/1975 | Massier | 195/81 |
| 3,934,999 | 1/1976 | Meier | 71/9 |
| 3,937,395 | 2/1976 | Lawes | 229/62.5 |
| 4,098,159 | 7/1978 | Rothfuss | 83/171 |
| 4,265,956 | 5/1981 | Colijn | 428/134 |
| 4,373,979 | 2/1983 | Planeta | 156/73.1 |
| 4,423,080 | 12/1983 | Bedrosian et al. | 426/118 |
| 4,485,133 | 11/1984 | Ohtsuka et al. | 428/35 |
| 4,487,791 | 12/1984 | Komatsu et al. | 428/35 |
| 4,503,561 | 3/1985 | Bruno | 383/102 |
| 4,515,266 | 5/1985 | Myers | 206/205 |
| 4,515,840 | 5/1985 | Gatward | 428/35 |
| 4,550,546 | 11/1985 | Raley et al. | 53/425 |
| 4,645,108 | 2/1987 | Gavin et al. | 225/103 |
| 4,656,900 | 4/1987 | Herrington | 83/24 |
| 4,657,610 | 4/1987 | Komatsu et al. | 156/87 |
| 4,667,552 | 5/1987 | Calligarich | 83/171 |
| 4,672,684 | 6/1987 | Barnes et al. | 383/45 |
| 4,693,152 | 9/1987 | Grosz et al. | 83/24 |
| 4,714,353 | 11/1987 | Leaphart | 383/117 |
| 4,732,065 | 3/1988 | Herrington | 83/18 |
| 4,734,196 | 3/1988 | Kono et al. | 210/500.36 |
| 4,734,324 | 3/1988 | Hill | 428/317.3 |
| 4,735,308 | 4/1988 | Barner | 206/204 |
| 4,743,123 | 5/1988 | Legters et al. | 383/103 |
| 4,753,538 | 6/1988 | Jorda | 383/8 |
| 4,759,246 | 7/1988 | Herrington | 83/37 |
| 4,771,962 | 9/1988 | Gavin et al. | 242/56.9 |
| 4,830,863 | 5/1989 | Jones | 426/118 |
| 4,840,823 | 6/1989 | Chigami et al. | 426/118 |
| 4,842,794 | 6/1989 | Hovis et al. | 264/145 |
| 4,842,875 | 6/1989 | Anderson | 426/118 |
| 4,847,145 | 7/1989 | Matsui | 428/323 |
| 4,854,520 | 8/1989 | Gavin et al. | 242/72 |
| 4,859,519 | 8/1989 | Cabe, Jr. et al. | 428/131 |
| 4,861,957 | 8/1989 | Welles | 219/10.55 |
| 4,879,124 | 11/1989 | Oberle | 426/113 |
| 4,886,372 | 12/1989 | Greengrass et al. | 383/100 |
| 4,897,274 | 1/1990 | Candida et al. | 426/130 |
| 4,905,452 | 3/1990 | Vogan | 53/412 |
| 4,910,032 | 3/1990 | Antoon, Jr. | 426/118 |
| 4,911,872 | 3/1990 | Hureau et al. | 264/146 |
| 4,923,703 | 5/1990 | Antoon, Jr. | 426/118 |
| 4,935,271 | 6/1990 | Schirmer | 428/35.2 |
| 4,939,030 | 7/1990 | Tsuji et al. | 428/315.5 |
| 4,948,267 | 8/1990 | Kaldenbaugh | 383/63 |
| 4,949,847 | 8/1990 | Nagata | 426/106 |
| 4,957,791 | 9/1990 | Richter | 428/35.5 |
| 4,978,231 | 12/1990 | Ling et al. | 383/11 |
| 4,978,486 | 12/1990 | Ito et al. . | |
| 5,002,782 | 3/1991 | Oberle | 426/113 |
| 5,024,538 | 6/1991 | Goglio | 383/103 |
| 5,059,036 | 10/1991 | Richison | 383/104 |
| 5,070,584 | 12/1991 | Dais et al. . | |
| 5,082,466 | 1/1992 | Rubenstein et al. | 8/142 |
| 5,086,914 | 2/1992 | Mish et al. | 206/63.3 |
| 5,086,924 | 2/1992 | Oberle | 206/497 |
| 5,102,225 | 4/1992 | Hollinger | 383/23 |
| 5,108,669 | 4/1992 | van Dijk et al. . | |
| 5,116,660 | 5/1992 | Komatsu et al. | 428/192 |
| 5,118,019 | 6/1992 | Harrison | 224/42.46 |
| 5,120,585 | 6/1992 | Sutter et al. | 428/34.2 |
| 5,132,151 | 7/1992 | Graney | 428/40 |
| 5,143,769 | 9/1992 | Moriya et al. | 428/76 |
| 5,150,970 | 9/1992 | Albarelli | 383/76 |
| 5,171,593 | 12/1992 | Doyle | 426/106 |
| 5,178,277 | 1/1993 | Brown et al. | 206/439 |
| 5,178,469 | 1/1993 | Collinson | 383/1 |

VEGETABLE CONTAINING STORAGE BAG AND METHOD FOR STORING SAME

CROSS-REFERENCE TO RELATED APPLICATION

This is a continuation of application Ser. No. 07/874,653, filed Apr. 27, 1992 now abandoned.

BACKGROUND OF THE INVENTION

This invention relates to food packaging film and food storage bags made from said film for storing, for example, produce such as vegetables and fruits. More particularly, this invention relates to flexible produce storage bags having a pattern of microholes specifically designed to allow produce contained in the bag to breathe in a controlled rate, such that localized condensation is reduced, which in turn, reduces microbial (bacteria and mold) growth and produce mushiness (softness). The perforated bags of the present invention also control the weight loss of the stored produce, thus minimizing the shriveling and wilting of unpackaged products.

Because fresh fruits and vegetables give off gases and retain moisture when stored in bags, it has long been a challenge for the packaging industry to provide a container or bag for storing produce that will help maintain the quality or shelf life of the produce while stored.

There are several well-known techniques available for packaging of produce to maintain their quality or extend their shelf life, including, for example, the use of controlled modified atmosphere packaging, shrink wraps, functional or active packaging and impermeable plastic storage bags. However, such known procedures do not adequately control or maintain the quality of produce. There is still a need in the industry for a packaging material such as a storage bag that will minimize local condensation and produce weight loss.

In an attempt to address the condensation problem of stored produce, U.S. Patent No. 4,735,308 discloses an internally lined food storage bag useful in the storage of moisture-retentive foods, such as fruit and vegetables. The storage bag comprises a hand-closed water-impermeable outer bag containing an absorbent inner bag. The construction of the bag described in U.S. Pat. No. 4,735,308 is complicated and does not involve the use of microperforations to control the perspiration of produce.

It is also known to provide a ventilated plastic bag, for example, a bag containing slits as described in U.S. Pat. No. 3,399,822 or bags with microperforations as described in U.S. Pat. No. 4,886,37, for storing vegetables. U.S. Pat. No. 3,399,822, for example, provides slits in a plastic bag to prevent contamination of vegetables stored in the bag, but does not address the moisture or weight loss problem of stored vegetables.

U.S. Pat. No. 4,886,372, for example, discloses controlling the ripening of produce and fruits by using a container or bag having a selected size and number of openings therein. However, the holes of the bags of U.S. Pat. No. 4,886,372 are too large, for example, from 20 mm to 60 mm, for adequate control of the weight loss of the produce. The prior art also describes bags having microholes which are too small or too many and are not suitable for storing small quantities of produce for in-home consumer use.

In view of the deficiencies of the prior art, it is desired to provide a film and food storage bag with microperforations of a size and number which maintains the quality of produce and reduces the problems associated with produce packaged in a prior art ventilated bag, in a totally sealed impermeable package or in a control/modified atmosphere package.

SUMMARY OF THE INVENTION

The present invention is directed to a food storage bag or wrap which has a pattern of microholes specifically designed to allow producer such as vegetables and fruits, to breathe in a controlled rate, thus minimizing water droplet accumulation, which reduces microbial (bacteria and mold) growth and produce mushiness (softness).

The designed pattern of microholes controls the weight loss of produce which otherwise may lead to produce shriveling and wilting. According to the present invention, the microholes would maintain the quality and increase the apparent shelf life of vegetables and fruits.

The present invention is independent of product, shape, amount and transpiration characteristics of stored produce as opposed to controlled atmosphere which generally is designed for each specific packaged product.

One preferred embodiment of the present invention is directed to clear, microperforated zippered bags as opposed to opaque unperforated functional films.

In addition, the microperforated bag of the present invention reduces localized condensation in the bag which localized condensation is evident with the use of regular unperforated storage/freezer plastic bags.

The perforated bags of the present invention also control the weight loss of the stored produce, thus minimizing the shriveling and wilting of unpackaged products.

DETAILED DESCRIPTION OF THE PREFERRED EMBODIMENTS

In its broadest scope, the present invention includes a flexible thermoplastic film material for packaging produce comprising a web of thermoplastic material having a selected number and size of microperforations. In producing the microperforations in a film web, small amounts of film material are removed from the film web to leave a void area sufficient to provide the film with a ratio of void area to surface area of web to sufficiently control weight loss and localized condensation of produce when such film is used for packaging produce.

The thermoplastic material useful in the present invention includes, for example, polyolefins, such as polypropylene or polyethylene or other known plastics. The film can be made of a monolayer or multilayer construction. The film is preferably used for packaging or wrapping produce. In a more preferred embodiment, containers or bags are manufactured from the film.

In one embodiment of the present invention, a flexible food storage bag with a preferred pattern of microperforations is prepared.

Figure 1:
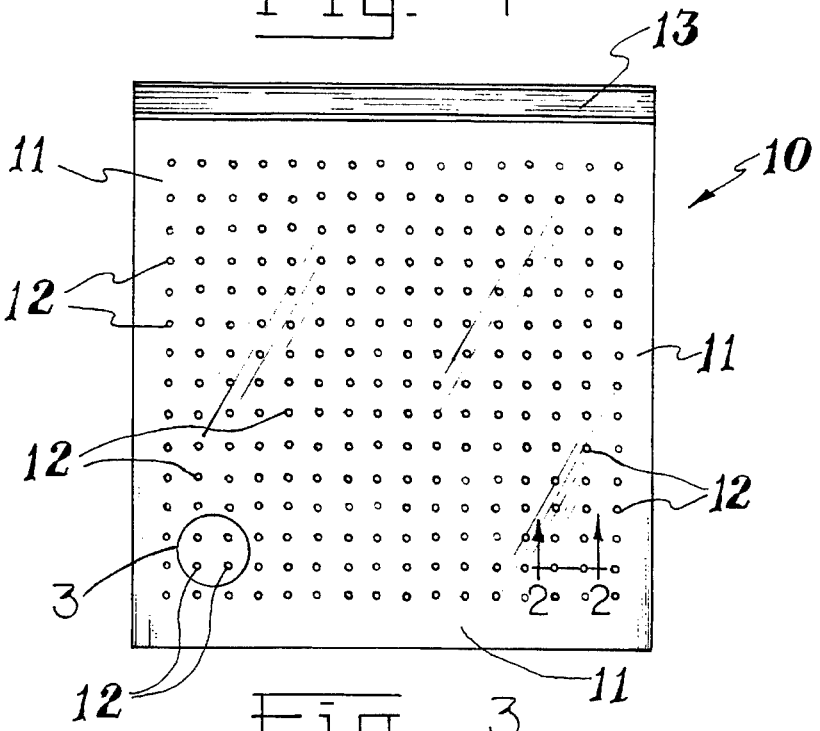
FIG. 1 shows a perspective view of a food storage bag of the present invention.
Figure 3:
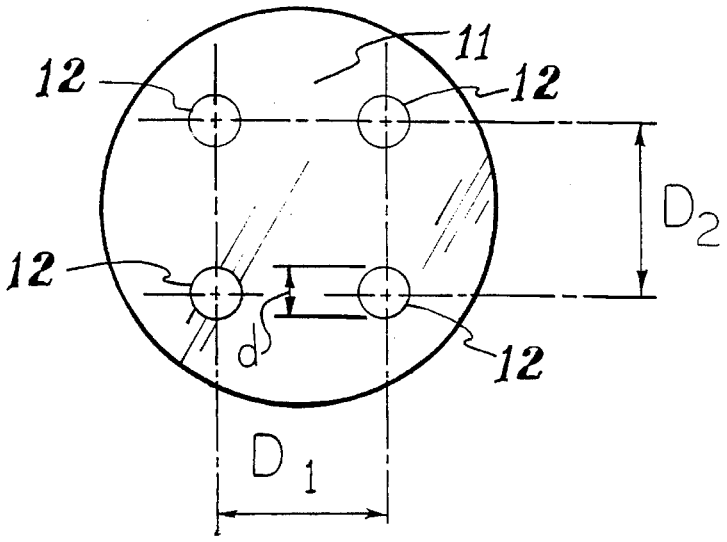
FIG. 3 shows a partial, enlarged section of the bag illustrated in FIG. 1.
Figure 2:
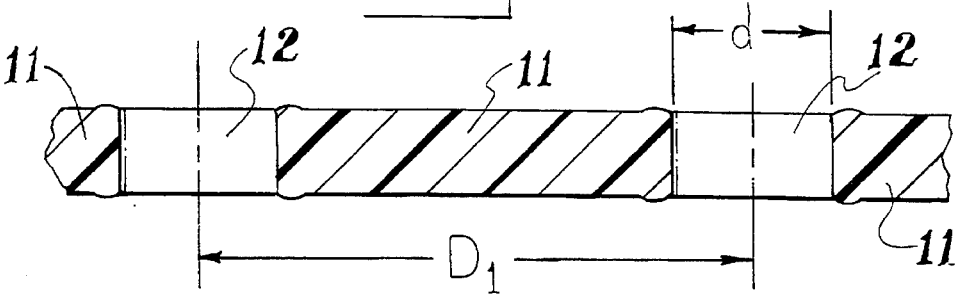
FIG. 2 shows a partial, enlarged cross sectional view taken along line 2—2 of FIG. 1.

One preferred embodiment of the bag of the present invention includes, for example, a zippered plastic bag as shown in FIGS. 1 to 3. The method of making such zippered bags is described in U.S. Pat. No. 5,070,584 issued to Dais et al., incorporated herein by reference. Other features that can be added to the bag can include, for example, pleats(e.g., a pleat at the bottom of the bag), printed surfaces, tinted colors, and textured or embossed surfaces, manufactured by well known techniques.

The zippered-type bags of the present invention are preferably produced from the film web using a well known heat sealer described in U.S. Pat. No. 5,012,561 issued to Porchia et al., incorporated herein by reference. Generally, the bag is produced by folding a web in half to create a bottom and then heat sealing along its sides leaving an opening at the top for a hand sealable closure, such as a zipper means, i.e., interlocking plastic ridges, which can be pressed together to seal the bag and pried or pulled apart to reopen the bag.

The food products to be stored in the bags can be a variety of moisture-retaining type foods, such as fresh fruits and vegetables. Fruits and vegetables can include, for example, "low respiring" produce such as grapes and carrots, "medium respiring" produce such as lettuce, and "high respiring" produce such as broccoli. By "low respiring" it is meant produce having a range of respiration rate (ml $CO_2$/kg·hr) of less than 10; by "medium respiring" it is meant produce having a range of respiration rate of from 10–20; and by "high respiring" it is meant produce having a range of respiration rate of greater than 20. The terms "low respiring", "medium respiring", and "high respiring" are commonly known in the art and some examples are described in Table 1 of Postharvest Physiology of Vegetables, J. Welchmann, Marcel Dekker, Inc., New York, New York, 1987, page 33.

For the best results in the storage of produce, the bag with produce is stored at refrigeration temperatures. Generally, the temperature is less than about 15° C., preferably less than about 10° C. and more preferably less than about 5° C.

The terms "microperforations" and "microholes" are used herein interchangeably to mean very small holes, the size of the holes being generally less than about 2000 microns (μ)in diameter. When storing any type of produce in the bags of the present invention, the microholes in the bag are preferably from greater than about 250 μ to about 1900 μ in diameter; more preferably from about 300 μ to about 800 μ in diameter, and most preferably from about 400 μ to about 600 μ for minimizing weight loss and condensation of the produce regardless of the type of produce stored in a bag. When storing a produce having a specific respiration rate, the size of holes can vary. For example, for "low respiring" type produce, the size of the holes may be, for example, from about 150 μ to about 1900 μ in diameter, preferably from about 100 μ to 1600 μ in diameter, and more preferably from about 180 μ to about 600 μ in diameter. For "medium respiring" type produce, the size of the holes may be, for example, from about 100 μ to about 1200 μ in diameter, preferably from about 150 μ to about 1000 μ in diameter, and more preferably from about 200 μ to about 800 μ in diameter. For "high respiring" type produce, the size of the holes may be, for example, from greater than about 250 μ to about 950 μ in diameter, preferably from greater than about 325 μ to about 850 μ in diameter, and more preferably from about 350 μ to about 800 μ in diameter.

The number and size of the holes should be sufficient to provide the required void fraction or ratio of the total void area of the bag to the total surface area of the bag. The percent void area per bag area can be determined using the following formula:

$$V=[(H)^2 X (\pi/4) X D] X 100$$

wherein V=the percent void area per bag area; H=hole diameter; D=hole density (which is the number of holes per bag area).

When storing any type of produce in the bag of the present invention, preferably the percent void area per bag area is in the range of from about 0.05 to about 2.75 percent, preferably from about 0.07 to about 0.5 percent, more preferably from about 0.12 to 0.27 percent. When storing a produce having a specific respiration rate, the void area per bag area can vary. For example, for "low respiring" type produce the percent void area is from about 0.002 to 2.75 percent, preferably from about 0.008 to about 1.95 percent, more preferably from about 0.017 to about 0.27 percent. For "medium respiring" type produce the percent void area is from about 0.008 to about 1.10 percent, preferably from about 0.017 to about 0.75 percent, more preferably from about 0.03 to about 0.5 percent. For "high respiring" type produce the percent void area is from about 0.07 to about 0.62 percent, preferably from about 0.08 to about 0.55 percent and more preferably from about 0.09 to about 0.5 percent.

The shape of the microholes is not critical, as long as the holes allow moisture to pass therethrough. Typically, the holes are circular or elliptical in shape.

In general, the microholes can vary in size, but preferably all of the microholes used in a bag are substantially the same size. To obtain the beneficial effects of the present invention, the microholes should be of a uniform size and uniformly distributed throughout the surface of the bag.

By "uniformly distributed" it is meant that the microholes are substantially identically and substantially evenly spaced apart from each other over the entire surface area of a web film or bag. The microholes are preferably in a polka-dot like matrix or pattern wherein the holes are in a square pattern or triangle pattern equally spaced apart. The microholes can also be in a randomly scattered pattern, however, any two adjacent holes are preferably no more than about 2 inches apart so that localized condensation is minimized. More preferably, the distance of the spacing, $D_1$ and $D_2$ (as seen in FIG. 3), of the microholes can be, for example, from about 0.2 inch to about 0.9 inch, preferably from about 0.3 inch to about 0.6 inch, and more preferably from about 0.4 inch to about 0.5 inch. As an illustration, the microholes can be distributed in a polka-dot like square pattern at 13/32 inch apart at a distance from center to center of the holes ($D_1$ and $D_2$) as shown in FIG. 3.

Figure 4:
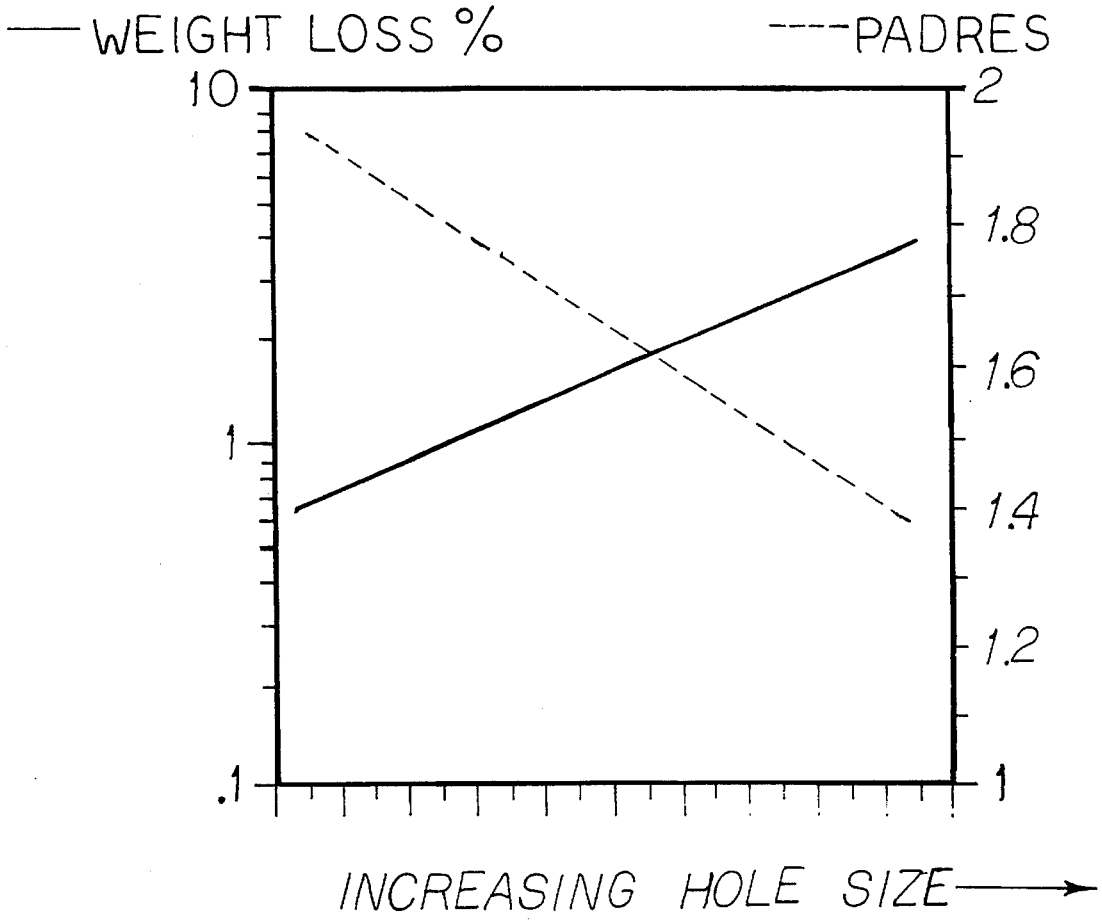
FIG. 4 is a graphical illustration of percent weight loss and Padres Number for produce versus hole size of a bag containing the produce.

The film or bag of the present invention with an array of microholes as described herein advantageously minimizes the weight loss and localized condensation of produce packaged in such film or bag. FIG. 4 shows a graphical representation of the weight loss and localized condensation (quantified by "Padres Number" described herein below) of produce versus hole size. It is desirable to reduce or minimize the weight loss of produce as much as possible and ideally to eliminate weight loss all together. Generally, if the weight loss is kept below about 8 percent, the produce is substantially preserved for use. Preferably, the produce weight loss is no more than about 6 percent, more preferably less than 5 percent and most preferably less than about 3 percent.

The localized condensation of the produce in the present invention is quantified by use of the unit referred to herein as "Padres Number".

The amount of condensation in the form of water that remains inside a bag after a period of storage is quantified in the present invention, as illustrated in Example 6 and Tables XIX to XXV, by assigning to the results a unit referred to herein as a "Padres Number" calculated as follows:

$$\text{Padres Number}=\text{Log}[(C(g)/W_{tl}(g))X\ 100]$$

This condensation is due to the weight loss of produce that remains in the bag.

The curves of weight loss percent and Padres Number illustrated in FIG. 4 are of one typical example of produce tested in accordance with the present invention. The actual Padres Number of a particular produce will be dependent on the characteristics of the storage conditions and the type of produce stored. The slope of the Padres Number curve in FIG. 4 will change, for example, with produce type, temperature of storage, hole size of bag, length of time of storage and ambient relative humidity. In order to minimize condensation in the bag, the Padres Number in the present invention is generally less than 1.74, preferably less than about 1.7, more preferably less than about 1.65, most preferably less than about 1.6.

FIG. 4 illustrates the correlation between Padres Number, weight loss and hole size. As shown in FIG. 4, the smaller the Padres Number, the larger the hole sizer and therefore, there is less condensation present in a bag. On the other curve shown in FIG. 4, the smaller the hole size, the lower the weight loss and then, in order to minimize weight loss, the hole size should be as small as possible. Consequently, as shown in FIG. 4, where the two lines intersect for a particular produce at its respective storage conditions, the intersection point will be its optimum hole size for the void fraction for the bag of the present invention.

With reference to FIGS. 1 to 3, again, there is shown a thermoplastic bag 10 made from a flexible web material normally used for such food storage bags, for example, a thermoplastic film web 11 such as polyethylene, polypropylene or other known plastics.

The film 11 of the bag is provided with a plurality of microperforations 12 disposed in an arrangement or pattern, for example, as shown in FIG. 1. If desired, as shown in FIG. 1, the bag 10 is provided with a closure means 13, including, for example a zipper-type closure, adhesive tape, wire tie or the like. Preferably an interlocking zipper-like closure number 13 is used for the bag 10.

The microholes can be disposed, for example, on one side of the bag 10 or on two sides of the bag 10 as long as the microholes are uniformly distributed throughout the surface of the one side or two sides of the bag and the numbers and size of the microholes is sufficient to provide the required void fraction described above.

To produce the microperforations in a film web or in the bag, any conventionally known perforating process or means can be used, including, for example, laser perforation, puncturing means, microperforating means, air pressure means and the like. Preferably, the microperforations are produced using a microperforating means, for example, using a microperforator described in U.S. Pat. No. 4,667,552, incorporated herein by reference.

Experimental Procedures

In each of the Examples below, the weight loss of the produce and the condensation in each of the bags described below was determined as follows: The produce was weighed initially ($W_i$) before being placed in a bag. After an elapsed period of time, the total weight of the bag and produce stored in such bag was measured ($W_t$) at the time of the test measurement. Then, the produce was taken out of the bag and surface dried by wiping with a cloth, and the weight of the produce measured ($W_p$). Then, the inside surface of the bag was wiped dry of any moisture present in the bag and the weight of the bag ($W_b$) was measured.

The difference between $W_i$–$W_p$ is the total weight loss ($W_{tl}$) of the produce in grams and the percent weight loss is as follows:

$$\frac{W_{tl}}{W_i} \times 100 = \text{percent weight loss of the produce (\%)}$$

The condensation (C) in the bag was calculated in grams as follows:

$$W_t-(W_p+W_b)=C(\text{grams})$$

The Padres Number is determined as herein above described and illustrated in FIG. 4 and in Example 6, Tables XIX to XXV.

Example 1

FIG. 1 shows the pattern of microholes used in this Example. The pattern used consisted of a 20×20 hole matrix on each of the two faces of a one-gallon (10 and 9/16 inches wide by 11 inches deep; 1.75 mils thick) plastic bag. Bags containing 800 holes, at 10 micron, 100 micron and 439 micron hole size, were produced. Twelve bags containing broccoli ("high respiring produce"), 12 bags containing green peppers ("medium respiring produce") and 12 bags containing green grapes ("low respiring produce") were tested. The vegetables were stored in the bags at a temperature of 5° C. and 30–35 percent RH (refrigerator conditions) for two weeks. The weight loss of each produce was measured and physical appearance observed periodically during the two week period, i.e., the produce's condensation, sliminess, mold growth, wilting or shriveling was visually evaluated during and at the end of the two week period. All of the results reported herein are based on an average of three measurements.

The results of this Example can be found in Tables I, II and III.

TABLE I

Weight loss (%) for Broccoli in gallon size bags with different hole size

| Time (Days) | Hole size: 439 microns(1) | Hole size: 100 microns(2) | Hole size: 10 microns(3) | Bag with no holes(2) | Control (un-packaged produce)(4) |
|---|---|---|---|---|---|
| 3 | 1.50 | 1.20 | 0.90 | 0.90 | 17.00 |
| 7 | 4.30 | 1.50 | 1.00 | 1.00 | 31.50 |
| 10 | 5.50 | 1.70 | 1.20 | 1.25 | 41.50 |
| 14 | 6.90 | 2.30 | 1.50 | 1.40 | 52.00 |

Notes:?
(1)No water accumulated.
(2)Water accumulated, off-odor on day 7.
(3)Water accumulated and leaked.
(4)Shriveling, rubbery, color change in day 3.

TABLE II

| Weight loss (%) for Green Peppers in gallon size bags with different hole size | | | | | |
|---|---|---|---|---|---|
| Time (Days) | Hole size: 439 microns[1] | Hole size: 100 microns[1] | Hole size: 10 microns[2] | Bag with no holes | Control (un-packaged produce)[3] |
| 3 | 0.90 | 0.40 | 0.10 | 0.20 | 4.80 |
| 7 | 1.70 | 0.75 | 0.30 | 0.40 | 9.60 |
| 10 | 2.50 | 1.00 | 0.55 | 0.65 | 14.80 |
| 14 | 3.80 | 1.30 | 0.80 | 0.75 | 19.50 |

Notes:
[1]No water accumulated.
[2]Water accumulated, mushy and color change on day 10.
[3]Shriveling, color change on day 7.

TABLE III

| Weight Loss (%) for Grapes in gallon size bags with different hole size | | | | | |
|---|---|---|---|---|---|
| Time (Days) | Hole size: 439 microns[1] | Hole size: 100 microns[1] | Hole size: 10 microns | Bag with no holes[2] | Control (unpackaged produce)[3] |
| 3 | 1.10 | 0.35 | — | 0.20 | 4.80 (1.00*) |
| 7 | 2.30 | 0.90 | — | 0.45 | 9.60 (2.50*) |
| 10 | 3.60 | 1.10 | — | 0.60 | 13.70 (3.50*) |
| 14 | 5.20 | 1.80 | — | 0.90 | 18.00 (4.60*) |

Notes:
*In crisper conditions (85–92% RH)
[1]No water accumulated.
[2]Water droplets in and moldy on day 7.
[3]Shriveling, moldy in day 3.

The above results indicate that bags with 439 microns size holes had the best results for all of the produce tested because no water accumulated in the bag and the vegetable was of good quality. Bags with 100 microns size holes performed well for the low and medium respiring produce. Bags with the 10 microns size holes and bags with no holes performed the same but did not reduce condensation which resulted in accumulating water droplets throughout the bag causing mushiness of the produce. The control (unpackaged) produce samples suffered significant weight loss which resulted in quality deterioration of the produce tested (shriveling and wilting).

The results obtained in this Example for the bag containing microperforations at 439 micron size was compared to bags made from various other materials with no microperforations and the results are described in Table IV.

TABLE IV

| | Weight Loss (%) in 14 days | | |
|---|---|---|---|
| Bag Sample | Broccoli | Green Peppers | Grapes |
| Bag with microholes at 439 micron | 6.90 | 3.80 | 5.20 |
| EVVIVO ™ (manufactured by Domo Pak; this bag contains slits having a 200 micron equivalent diameter and a density of 100 slits/square inch) | 34.40 | 12.50 | — |
| Control (unpackaged produce) | 52.00 | 19.50 | 18.00 |

Example 2

In this example, bags were prepared and measured as in Example 1. The following one gallon size bags Samples were tested at refrigerated and crisper conditions:

Sample 1: a bag having 800 holes with an average hole size of 439 micron in diameter.

Sample 2: a bag having 400 holes with an average hole size of 439 micron in diameter.

Sample 3: a bag having one hole (¼ inch in diameter).

Sample 4: an unperforated ZIPLOC® (trademark of The Dow Chemical Company) storage bag.

Sample 5: control (no package).

The storage conditions were as follows:

Refrigeration: (5° C./30–35% relative humidity (RH)) for 14 days.

Crisper: (5° C./85–92% RH) for 14 days.

The produce tested included broccoli and green peppers (about 1 pound). The weight loss (%) was determined and observations recorded as described in Tables V and VI. The perforated bags samples listed in Tables V and VI are indicated by "(number of holes/diameter of holes (μ))."

TABLE V

| Weight Loss (%) for Broccoli in different bags | | | | | |
|---|---|---|---|---|---|
| Time (Days) | Sample 1[4] (800/439) | Sample 2[2] (400/439) | Sample 3[1] (1/0.25 inches) | Sample 4[1] (no holes) | Sample 5[3] Control |
| 3 | 1.86 | 1.51 | 0.75 | 0.71 | 14.10 |
| 7 | 3.73 | 2.45 | 1.28 | 0.85 | 20.35 |
| 14 | 7.40 | 4.24 | 1.80 | 1.30 | 48.50 |
| 14* | 2.35* | 2.05* | 1.25* | 1.10* | 19.20* |

*In crisper.
Notes:
[1]Bags did not perform due to excessive condensation and off-odor development.
[2]Did not perform well due to condensation.
[3]Control (unpackaged) samples were rubbery, shriveled and discolored (brownish and yellowish color). Crisper condition did not help.
[4]Had the best results. Few water droplets were observed.

TABLE VI

| Weight Loss (%) for Green Peppers in different bags | | | | | |
|---|---|---|---|---|---|
| Time (Days) | Sample 4[4] (800/439) | Sample 2[2] (400/439) | Sample 3[1] (1/0.25 inches) | Sample 4[1] (no holes) | Sample 5[3] Control |
| 3 | 0.95 | 0.55 | 0.35 | 0.28 | 5.10 |
| 7 | 1.95 | 1.20 | 0.73 | 0.57 | 8.90 |
| 14 | 4.10 | 2.63 | 1.25 | 0.90 | 17.20 |

Notes:
[1]Water accumulated.
[2]Few water droplets.
[3]Control (unpackaged) samples were shriveled.
[4]No water accumulation.

Example 3

In this Example bags were prepared and measured as in Example 1. The following one gallon size bags were tested at crisper storage conditions (5° C./85–95% RH):

Sample 6: a bag having 800 holes with an average hole size of 578 micron in diameter.

Sample 7: a bag having 1200 holes with an average hole size of 414 micron in diameter.

Sample 8: a bag having 800 holes with an average hole size of 439 micron in diameter.

Sample 9: a bag having 600 holes with an average hole size of 405 micron in diameter.

The produce tested included broccoli and green peppers. The weight loss (%) was determined and recorded as described in Tables VII and VIII. The perforated bag samples listed in Tables VII and VIII are indicated by "(number of holes/diameter of holes (μ))."

TABLE VII

| Weight Loss (%) for Broccoli in different bags | | | | |
|---|---|---|---|---|
| Time (Days) | Sample 6[1] (800/578) | Sample 7[3] (1200/414) | Sample 8[2] (800/439) | Sample 9[2] (600/405) |
| 3 | 3.14 | 1.38 | 1.25 | 0.98 |
| 7 | 6.04 | 2.20 | 2.10 | 1.80 |
| 14 | 9.42 | 4.10 | 3.40 | 2.85 |

Notes:
[1]Samples were slightly shriveled (day 7).
[2]Few water droplets were observed.
[3]Had the best overall results (almost no water droplets, no discoloration with firm texture).

TABLE VIII

| Weight Loss (%) for Green Peppers in different bags | | | | |
|---|---|---|---|---|
| Time (Days) | Sample 6[2] (800/578) | Sample 7[2] (1200/414) | Sample 8[2] (800/439) | Sample 9[1] (600/405) |
| 3 | 0.95 | 0.65 | 0.60 | 0.50 |
| 7 | 1.87 | 0.98 | 0.82 | 0.63 |
| 14 | 2.96 | 1.87 | 1.70 | 1.47 |

Notes:
[1]Few water droplets were observed.
[2]The quality of the produce stored was satisfactory.

In this Example it was determined that weight loss (%) will be greater at the refrigerated conditions (30–35% RH) as compared to crisper conditions (85–92% RH).

Based on the above results, it was determined that Sample 7 (414 micron/1200 holes) had the best overall results.

Example 4

In this Example the effect of various temperatures was studied on the following one gallon size bags:

Sample 10: a bag having 800 holes with an average hole size of 439 micron in diameter.

Sample 11: a bag having 1200 holes with an average hole size of 414 micron in diameter.

Sample 12: a bag having 1600 holes with an average hole size of 337 micron in diameter.

Sample 13: an unperforated ZIPLOC® storage bag.

The storage conditions were as follows: 5° C., 10° C., 15° C./30–35% RH

The produce tested included broccoli and green peppers (about 1.0 pound).

The weight loss (%) was measured and observation of the produce was recorded as described in Tables IX through XIV. The perforated bag samples in Tables IX through XIV are indicated by "(number of holes/diameter of holes (μ))."

TABLE IX

| Weight Loss (%) for Broccoli at 5° C. | | | | |
|---|---|---|---|---|
| Time (Days) | Sample 10[1] (800/439) | Sample 11[2] (1200/414) | Sample 12[2] (1600/337) | Sample 13[4] (no holes) |
| 3 | 1.90 | 2.25 | 2.32 | — |
| 7 | 2.97 | 4.00 | 4.21 | 0.90 |
| 14 | 5.73 | 7.10 | 7.95 | 1.55 |

Notes:
[1]Few water droplets (after day 7).
[2]No water droplets.
[4]Had water accumulation combined with strong off-odor.

TABLE X

| Weight Loss (%) for Broccoli at 10° C. | | | | |
|---|---|---|---|---|
| Time (Days) | Sample 10[1] (800/439) | Sample 11[2] (1200/414) | Sample 12[2] (1600/337) | Sample 13[3] (no holes) |
| 3 | 1.94 | 2.23 | 2.73 | — |
| 7 | 3.62 | 4.85 | 6.00 | 1.10 |
| 14 | 6.20 | 8.13 | 9.30 | 1.93 |

Notes:
[1]Water droplets were observed (day 7 and up).
[2]Very few water droplets but slight shriveling was noticed.
[3]Had water accumulation and strong off-odor.

TABLE XI

| Weight Loss (%) for Broccoli at 15° C. | | | | |
|---|---|---|---|---|
| Time* (Days) | Sample 10 (800/439) | Sample 11 (1200/414) | Sample 12 (1600/337) | Sample 13 (no holes) |
| 3 | 2.98 | 3.66 | 3.94 | — |
| 7 | 5.20 | 7.26 | 8.89 | 2.42 |

Notes:
*Experiment was terminated for all bags after day 7 due to excessive off-odor, shriveling and severe discoloration (yellowish and brownish color).

TABLE XII

| Weight Loss (%) for Green Peppers at 5° C. | | | | |
|---|---|---|---|---|
| Time (Days) | Sample 10 (800/439) | Sample 11 (1200/414) | Sample 12 (1600/337) | Sample 13[1] (no holes) |
| 3 | 0.81 | 1.25 | 1.29 | — |
| 7 | 2.10 | 2.31 | 2.48 | 0.51 |
| 14 | 3.92 | 4.80 | 6.10 | 0.95 |

Notes:
No water droplets were observed in all treatments except Sample 13 and the quality of peppers (color, odor, texture) was excellent.
[1]Had water accumulation and off-odor but texture and color were very good.

TABLE XIII

| Weight Loss (%) for Green Peppers at 10° C. | | | | |
|---|---|---|---|---|
| Time (Days) | Sample 10 (800/439) | Sample 11 (1200/414) | Sample 12 (1600/337) | Sample 13 (no holes) |
| 3 | 1.10 | 1.63 | 1.70 | — |
| 7 | 2.44 | 3.20 | 3.65 | 0.73 |
| 14 | 4.35 | 6.10 | 7.30 | 1.21 |

TABLE XIII-continued

| Weight Loss (%) for Green Peppers at 10° C. | | | | |
|---|---|---|---|---|
| Time (Days) | Sample 10 (800/439) | Sample 11 (1200/414) | Sample 12 (1600/337) | Sample 13 (no holes) |

Notes:
Same results as 5° C. except a slight shriveling was observed in 1600/337. Water accumulation and strong off-odor in Sample 13.

TABLE XIV

| Weight Loss (%) for Green Peppers at 15° C. | | | | |
|---|---|---|---|---|
| Time* (Days) | Sample 10 (800/439) | Sample 11 (1200/414) | Sample 12 (1600/337) | Sample 13[1] (no holes) |
| 3 | 1.45 | 1.68 | 1.85 | — |
| 7 | 3.50 | 3.95 | 4.45 | 0.92 |
| 14 | 4.73 | 6.23 | 6.93 | 1.40 |

Notes:
*Experiment was terminated after day 10 due to shriveling and discoloration (yellowish, reddish colors) in 1200/414 and 1600/337.
[1]Sliminess, water accumulation and off-odor were observed.

The above results of this Example indicated that the best results were obtained with Sample 11 and Sample 12 at refrigerated conditions (30–35% RH/5–10° C.).

The average temperature in a house-refrigerator is commonly below about 8° C.

Example 5

In this Example the effectiveness of quart size (7 inches by 8 inches; 1.7 mil thick) bags on maintaining the quality of produce was tested using the following bags:

Sample 14: a bag having 1200 holes with an average hole size of 414 micron in diameter.

Sample 15: a bag having 1600 holes with an average hole size of 337 micron in diameter.

Sample 16: an unperforated ZIPLOC® bag.

The produce tested included broccoli and green peppers (about ½ pound ).

The storage conditions were as follows: 5° C. and 10° C./30–35% RH.

The weight loss (%) was measured and observations of the produce was recorded as described in Tables XV through XVIII. The perforated bag samples in Tables XV through XVIII are indicated by "(number of holes/diameter of holes (μ))."

TABLE XV

| Weight Loss (%) for Broccoli at 5° C. | | | |
|---|---|---|---|
| Time (Days) | Sample 14 (1200/414) | Sample 15 (1600/337) | Sample 16[1] (no holes) |
| 7 | 4.35 | 4.89 | 0.94 |
| 10 | 6.50 | 7.40 | 1.20 |

Notes:
[1]Water accumulation combined with off-odor.

TABLE XVI

| Weight Loss (%) for Broccoli at 10° C. | | | |
|---|---|---|---|
| Time (Days) | Sample 14 (1200/414) | Sample 15 (1600/337) | Sample 16[1] (no holes) |
| 7 | 5.63 | 6.40 | 1.35 |
| 10 | 7.80 | 8.70 | 1.58 |

Notes:
[1]Water accumulation combined with off-odor.

TABLE XVII

| Weight Loss (%) for Green Pepper at 5° C. | | | |
|---|---|---|---|
| Time (Days) | Sample 14 (1200/414) | Sample 15 (1600/337) | Sample 16[1] (no holes) |
| 7 | 3.10 | 3.35 | 0.45 |
| 10 | 4.25 | 5.63 | 0.90 |

Notes:
[1]Water droplets and off-odor.

TABLE XVIII

| Weight Loss (%) for Green Pepper at 10° C. | | | |
|---|---|---|---|
| Time (Days) | Sample 14 (1200/414) | Sample 15 (1600/337) | Sample 16[1] (no holes) |
| 7 | 3.53 | 3.98 | 0.80 |
| 10 | 5.75 | 6.45 | 1.15 |

Notes:
[1]Water droplets and off-odor.

Examples 6

In this Example the Padres Number was determined for different bag samples having different hole sizes as described in Tables XIX to XXV according to the same conditions in Example 5.

TABLE XIX

| | Broccoli at 5° C. - day 7 | | Broccoli at 10° C. - day 7 | |
|---|---|---|---|---|
| Average Hole Size (Microns) | Average Total weight loss (%) | Padres Number | Average Total weight loss (%) | Padres Number |
| Ziploc ® (no holes) | 0.53 | 1.89 | 0.94 | 1.85 |
| 152 | 0.99 | 1.83 | 2.60 | 1.81 |
| 259 | 1.21 | 1.71 | 2.46 | 1.72 |
| 345 | 1.47 | 1.54 | 2.73 | 1.65 |
| 560 | 2.11 | 1.21 | 4.30 | 1.46 |
| 690 | 2.34 | 1.04 | 4.12 | 1.29 |
| 927 | 3.57 | 0.79 | 5.97 | 0.97 |
| Control (unpackaged produce) | 16.37 | −0.30 | 23.30 | −1.0 |

TABLE XX

| Average Hole Size (Microns) | Broccoli at 5° C. - day 10 Average Total weight loss (%) | Broccoli at 5° C. - day 10 Padres Number | Broccoli at 10° C. - day 14 Average Total weight loss (%) | Broccoli at 10° C. - day 14 Padres Number |
|---|---|---|---|---|
| Ziploc ® (no holes) | 0.71 | 1.84 | 1.06 | 1.78 |
| 152 | 1.10 | 1.79 | 1.40 | 1.74 |
| 259 | 1.61 | 1.67 | 1.71 | 1.56 |
| 345 | 2.30 | 1.39 | 2.36 | 1.47 |
| 560 | 2.26 | 1.22 | 3.13 | 1.12 |
| 690 | 3.52 | 0.76 | 4.34 | 0.90 |
| 927 | 5.40 | 0.66 | 8.43 | 0.20 |

Notes:
Control discontinued after day 7.

TABLE XXI

| Average Hole Size (Microns) | Lettuce at 5° C. - day 7 Average Total weight loss (%) | Lettuce at 5° C. - day 7 Padres Number | Lettuce at 10° C. - day 7 Average Total weight loss (%) | Lettuce at 10° C. - day 7 Padres Number |
|---|---|---|---|---|
| Ziploc ® (no holes) | 0.27 | 1.93 | 0.29 | 1.85 |
| 152 | 0.35 | 1.62 | 0.42 | 1.28 |
| 259 | 0.63 | 1.25 | 0.63 | 0.63 |
| 345 | 0.66 | 0.81 | 0.82 | 0.32 |
| 560 | 1.10 | 0.34 | 1.83 | −1.0 |
| 690 | 1.54 | 0.45 | 1.85 | −2.0 |
| 927 | 1.73 | −0.22 | 2.75 | −2.0 |
| Control (unpackaged produce) | 3.80 | −2.0 | 7.77 | −2.0 |

TABLE XXII

| Average Hole Size (Microns) | Lettuce at 5° C. - day 10 Average Total weight loss (%) | Lettuce at 5° C. - day 10 Padres Number | Lettuce at 10° C. - day 10 Average Total weight loss (%) | Lettuce at 10° C. - day 10 Padres Number |
|---|---|---|---|---|
| Ziploc ® (no holes) | 0.37 | 1.93 | 0.34 | 1.82 |
| 152 | 0.65 | 1.73 | 0.63 | 1.15 |
| 259 | 0.82 | 1.26 | 0.85 | 0.97 |
| 345 | 1.12 | 0.76 | 1.40 | 0.51 |
| 560 | 1.40 | −1.22 | 2.31 | −0.7 |
| 690 | 2.37 | 0.15 | 2.74 | −2.0 |
| 927 | 2.80 | 0.15 | 2.30 | −2.0 |

Notes:
Control discontinued after day 7.

TABLE XXIII

| Average Hole Size (Microns) | Lettuce at 5° C. - day 14 Average Total weight loss (%) | Lettuce at 5° C. - day 14 Padres Number | Lettuce at 10° C. - day 14 Average Total weight loss (%) | Lettuce at 10° C. - day 14 Padres Number |
|---|---|---|---|---|
| Ziploc ® (no holes) | 0.43 | 1.92 | 0.54 | 1.81 |
| 152 | 0.62 | 1.64 | 1.05 | 0.91 |
| 259 | 1.14 | 1.16 | 1.63 | 0.65 |
| 345 | 1.39 | 0.83 | 2.27 | 0.46 |
| 560 | 2.25 | −0.05 | 4.48 | −0.15 |

TABLE XXIII-continued

| Average Hole Size (Microns) | Lettuce at 5° C. - day 14 Average Total weight loss (%) | Lettuce at 5° C. - day 14 Padres Number | Lettuce at 10° C. - day 14 Average Total weight loss (%) | Lettuce at 10° C. - day 14 Padres Number |
|---|---|---|---|---|
| 690 | 3.10 | −0.22 | 5.83 | −0.22 |
| 927 | 3.34 | −2.0 | 5.30 | −2.0 |

Notes:
Control discontinued after day 7.

TABLE XXIV

| Average Hole Size (Microns) | Grapes at 5° C. - day 7 Average Total weight loss (%) | Grapes at 5° C. - day 7 Padres Number | Grapes at 10° C. - day 7 Average Total weight loss (%) | Grapes at 10° C. - day 7 Padres Number |
|---|---|---|---|---|
| Ziploc ® (no holes) | 0.24 | 1.95 | 0.26 | 1.68 |
| 152 | 0.27 | 1.65 | 0.46 | 1.43 |
| 259 | 0.87 | 1.28 | 0.57 | 1.04 |
| 345 | 0.56 | 1.28 | 0.82 | 0.83 |
| 560 | 0.94 | 0.65 | 1.21 | 0.45 |
| 690 | 1.21 | 0.11 | 1.17 | 0.23 |
| 927 | 1.70 | −0.1 | 1.86 | 0.04 |
| Control (unpackaged produce) | 2.83 | −2.0 | 5.15 | −2.0 |

TABLE XXV

| Average Hole Size (Microns) | Grapes at 5° C. - day 10 Average Total weight loss (%) | Grapes at 5° C. - day 10 Padres Number | Grapes at 10° C. - day 10 Average Total weight loss (%) | Grapes at 10° C. - day 10 Padres Number |
|---|---|---|---|---|
| Ziploc ® (no holes) | 0.37 | 1.91 | Discontinued | - bad mold |
| 152 | 0.54 | 1.72 | | |
| 259 | 0.65 | 1.53 | | |
| 345 | 0.71 | 0.99 | | |
| 560 | 1.17 | 0.26 | | |
| 690 | 1.90 | −0.22 | | |
| 927 | 2.10 | 0.08 | | |

Notes:
Control discontinued after day 7.

Example 7

In this Example the weight loss percent was determined for cut produce stored in quart size (7 inches wide by 8 inches deep, 1.7 mil thick) plastic bags at refrigerated conditions (10° C./70–80% RH) for 7 days. The experimental procedure in this Example was similarly carried out as in Example 1 except for the following samples and conditions as described in Table XXVI below:

Sample 17: a bag having 576 holes with an average hole size of 414 micron in diameter.

Sample 18: a bag having 768 holes with an average hole size of 337 micron in diameter.

Sample 19: an unperforated plastic Ziploc® bag.

Sample 20: control is unpackage produce.

The perforated bag samples listed in Tables XXVI are indicated by "(number of holes/diameter of holes(μ))."

TABLE XXVI

| Produce | Average Weight Loss (Percent) | | | |
|---|---|---|---|---|
| | Sample 17 (576/414) | Sample 18 (768/337) | Sample 19 (no holes) | Sample 20 Control |
| Lettuce[1] | 4.1 | 5.42 | 0.45 | 46.64 |
| Celery[2] | 2.4 | 2.76 | 0.34 | 15.68 |
| Peppers[3] | 6.8 | 7.44 | 1.41 | 27.94 |
| Broccoli[4] | 5.16 | 6.13 | 1.06 | 34.08 |
| Carrot[5] | 2.02 | 2.54 | 0.65 | 17.37 |

Notes:
[1]Slight discoloration in Samples 17, 18 and 19. Control was wilted, shriveled and discolored.
[2]Slight discoloration in Samples 17, 18 and 19. Control was shriveled.
[3]Wet and slight slime in Samples 17 and 18, more wet and slight slime in Sample 19. Control deteriorated.
[4]Samples 17 and 18 were satisfactory. Moisture build up in Sample 19. Control deteriorated.
[5]Samples 17 and 18 were satisfactory. Sample 19 had moisture build up. Control produce was wilted and shriveled.

What is claimed is:

1. Vegetable containing storage bag comprising (a) vegetables selected from the group consisting of low, medium or high respiring vegetables; and (b) a flexible food storage bag having the vegetables stored therein, said flexible food storage bag comprising a flexible bag having sidewalls, a bottom, side seams and a closable top, said bag being made from a thermoplastic flexible film and said bag having a plurality of microholes through the film of the bag, each of said microholes having a diameter of from about 250 microns to about 950 microns, said microholes uniformly distributed in the bag to provide a percent void area in the bag of from about 0.05 percent to about 2.75 percent, wherein the void area is defined by $$V=[(H)^2x(\pi/4)xD]x\ 100$$

wherein V=the percent void area per bag area; H=hole diameter; and D=hole density which is the number of holes per bag area; such that localized condensation in the bag is such that no matter what type of vegetables are stored in the bag –low, medium, or high respiring vegetables –the Padres number of the bag as represented in the formula $$\text{Padres Number}=\text{Log}\ [(C/W_{tl})x100$$

where C is the condensation in the bag calculated in grams, and $W_{tl}$ is the total weight loss of the vegetable calculated in grams, is less than 1.74 and the weight loss of the vegetables is less than about 8 percent when stored at a temperature of about 10° C. and at a relative humidity of about 30 percent for at least three days, the thickness of the bag wall being less than 5 mils.

2. The bag of claim 1 having a Padres Number of less than about 1.70.

3. The bag of claim 2 having a Padres Number of less than about 1.65.

4. The bag of claim 3 having a Padres Number of less than about 1.6.

5. The bag of claim 1 wherein the weight loss of the produce is kept to less than about 6 percent.

6. The bag of claim 5 wherein the weight loss of the produce is kept to less than about 5 percent.

7. The bag of claim 6 wherein the weight loss of the produce is kept to less than about 3 percent.

8. The bag of claim 1 wherein the size of the microhole is from about 300 microns to about 800 microns in diameter.

9. The bag of claim 8 wherein the size of the microholes is from about 400 microns to about 600 microns in diameter.

10. The bag of claim 1 wherein the size of the microholes is from about 325 microns to about 850 microns in diameter.

11. The bag of claim 1 wherein the hole density is from about 3 holes/in$^2$ to about 8 holes/in$^2$ 12. The bag of claim 11 wherein the hole density is from about 3.5 holes/in$^2$ to about 7 holes/in$^2$.

13. The bag of claim 12 wherein the holes density is from about 4 holes/in$^2$ to about 6.5 holes/in$^2$.

14. The bag of claim 1 wherein the percent void area is from about 0.07 to about 0.5 percent.

15. The bag of claim 14 wherein the percent void area is from about 0.12 to about 0.27 percent.

16. The bag of claim 1 wherein the thickness of the wall of the bag is less than about 3 mils.

17. The bag of claim 16 wherein the thickness of the wall of the bag is less than about 2 mils.

18. The bag of claim 1 wherein the distance between any two adjacent microholes is from about the diameter size of a microhole up to about 2 inches.

19. The bag of claim 18 wherein the distance is from 0.2 inch to about 0.9 inch.

20. The bag of claim 19 wherein the distance is from 0.3 inch to about 0.6 inch.

21. The bag of claim 20 wherein the distance is from 0.4 inch to about 0.5 inch.

22. The bag of claim 1 wherein the bag contains a zipper type closure.

23. The bag of claim 1 wherein the bag contains a pleat at the bottom of the bag.

24. The bag of claim 1 having a printed surface thereon.

25. The bag of claim 1 wherein the bag is tinted.

26. The bag of claim 1 having a textured surface

27. The bag of claim 1 having an embossed surface thereon.

28. A process for storing vegetables comprising storing the vegetable containing storage bag of claim 1 at a temperature of about 10° C. and at a relative humidity of about 30% wherein the weight loss of the vegetables is kept at less than about 8 percent for at least three days.

* * * * *